US006138613A

United States Patent [19]

Bourke et al.

[11] Patent Number: 6,138,613

[45] **Date of Patent: *Oct. 31, 2000**

[54] IGNITION INHIBITING GAS WATER HEATER

[75] Inventors: Brendan Vincent Bourke, Gordon; Zoran Valcic, Chatswood; Geoffrey Mervyn Whitford, Dundas, all of Australia

[73] Assignee: SRP 687 Pty Ltd., Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/138,359

[22] Filed: Aug. 21, 1998

Related U.S. Application Data

[63] Continuation of application No. 08/626,844, Apr. 3, 1996, Pat. No. 5,797,355.

[30] Foreign Application Priority Data

Apr. 4, 1995 [AU] Australia ..... PN2136
Sep. 22, 1995 [AU] Australia ..... PN5591

[51] Int. Cl.[7] ..... F22B 5/00

[52] U.S. Cl. ..... 122/13.1; 122/14; 122/17; 122/18; 122/504; 126/350 R; 126/42

[58] Field of Search ..... 122/13.1, 14, 17, 122/18, 15, 16, 504; 431/346, 72, 754; 126/42, 350 R

[56] References Cited

U.S. PATENT DOCUMENTS

| | | |
|---|---|---|
| 0,736,153 | 8/1903 | Reynolds . |
| 1,806,216 | 5/1931 | Plummer . |
| 1,841,463 | 1/1932 | Barber et al. . |
| 2,479,042 | 8/1949 | Gaines . |
| 3,161,227 | 12/1964 | Gross et al. . |
| 3,947,229 | 3/1976 | Richter . |
| 4,039,272 | 8/1977 | Elliot . |
| 4,080,149 | 3/1978 | Wolfe . |
| 4,177,168 | 12/1979 | Denny et al. . |
| 4,204,833 | 5/1980 | Kmetz et al. . |
| 4,241,723 | 12/1980 | Kitchen . |
| 4,510,890 | 4/1985 | Cowan . |
| 4,519,770 | 5/1985 | Kesselring et al. . |
| 4,639,213 | 1/1987 | Simpson . |
| 4,742,800 | 5/1988 | Eising . |
| 4,790,268 | 12/1988 | Eising . |

(List continued on next page.)

FOREIGN PATENT DOCUMENTS

| | | |
|---|---|---|
| 0 560 419 A2 | 9/1993 | European Pat. Off. . |
| 0 596 555 A1 | 5/1994 | European Pat. Off. . |
| 0 657 691 A1 | 6/1995 | European Pat. Off. . |
| 25 40 709 A 1 | 3/1977 | Germany . |
| 39 36 699 A 1 | 2/1991 | Germany . |
| 60-134117 | 7/1985 | Japan . |
| 62-162814 | 7/1987 | Japan . |
| WO 94/01722 | 1/1994 | WIPO . |

OTHER PUBLICATIONS

"Flame Traps —a Technical Note" Journal of Mines, Metals & Fuels, Jul. 1987.

*Primary Examiner*—Mark Paschall
*Assistant Examiner*—Jiping Lu
*Attorney, Agent, or Firm*—Schnader, Harrison, Segal, & Lewis LLP

[57] ABSTRACT

A gas water heater including a water container adapted to be heated by a gas burner; and an enclosure surrounding the burner, the enclosure having at least one entryway adapted to allow air and fumes to enter the enclosure without igniting flammable gases or vapors outside of the enclosure.

18 Claims, 10 Drawing Sheets

U.S. PATENT DOCUMENTS 4,823,770 4/1989 Loeffler .
4,863,370 9/1989 Yokoyama et al. .
4,869,232 9/1989 Narang .
4,872,443 10/1989 Ruark .
4,893,609 1/1990 Giordani et al. .
4,919,085 4/1990 Ishiguro .
4,924,816 5/1990 Moore, Jr. et al. .
4,960,078 10/1990 Yokoyama et al. .
5,044,928 9/1991 Yokoyama et al. .
5,085,205 2/1992 Hall et al. .
5,197,456 3/1993 Ryno .
5,205,731 4/1993 Reuther et al. .
5,215,457 6/1993 Sebastiani .
5,240,411 8/1993 Abalos .
5,246,397 9/1993 Petter .
5,317,992 6/1994 Joyce .
5,355,841 10/1994 Moore, Jr. et al. .
5,368,263 11/1994 Harrison .
5,385,467 1/1995 Sebastiani et al. .
5,397,233 3/1995 Eavenson et al. ..... 431/80
5,427,525 6/1995 Shukla et al. .
5,435,716 7/1995 Joyce .
5,448,969 9/1995 Stuart et al. .
5,494,003 2/1996 Bartz et al. .
5,520,536 5/1996 Rodgers et al. .
5,522,723 6/1996 Durst et al. .
5,531,214 7/1996 Cheek .
5,556,272 9/1996 Blasko et al. .
5,575,274 11/1996 DePalma .
5,588,822 12/1996 Hayakawa et al. .
5,649,821 7/1997 Fogliani et al. .
5,674,065 10/1997 Grando et al. ..... 431/54
5,791,298 8/1998 Rodgers .
5,797,358 8/1998 Brandt et al. .

IGNITION INHIBITING GAS WATER HEATER

This application is a continuation of application Ser. No. 08/626,844, filed Apr. 3, 1996 now U.S. Pat. No. 5,797,355.

FIELD OF INVENTION

The present invention relates to arrangements to make gas fired water heaters safer for use.

BACKGROUND OF INVENTION

The most commonly used gas-fired water heater is the storage type, generally comprising an assembly of a water tank, a main gas burner to provide heat to the tank, a standing pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame. For convenience, the following description is in terms of storage type water heaters but the present invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that they are also used for storage of other equipment such as lawn mowers, trimmers, snow blowers and the like. It is a common procedure for such machinery to be refueled in such locations.

There have been a number of reported instances of spilled gasoline and associated fumes being accidently ignited. There are many available ignition sources, such as refrigerators, running engines, electric motors, electric light switches and the like. However, gas water heaters have sometimes been suspected because they often have a pilot flame.

Any vapors from spilt or escaping flammable liquid or gaseous substances in a space in which an ignition source is present, provides a potential for ignition. "Fumes," "extraneous gases" or "extraneous fumes" is sometimes hereinafter used to encompass gases, vapors or fumes generated by a wide variety of liquid volatile or semi-volatile substances such as gasoline, kerosine, turpentine, alcohols, insect repellent, weed killer, solvents and the like as well as non-liquid substances such as propane, methane, butane and the like. Many inter-related factors influence whether a particular fuel spillage does lead to ignition. These factors include, among other things, the quantity, the nature and physical properties of the particular type of spilt fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges capable of enabling ignition are not reached given all the surrounding circumstances.

One surrounding circumstance is the relative density of the fumes. When a spilt liquid fuel spreads on a floor, normal evaporation occurs and fumes from the liquid form a mixture with the surrounding air that may, at some time and at some locations, be within the range that will ignite. For example, that range for common gasoline vapor is between 3% and 8% gasoline with air, for butane between 1% and 10%. Such mixtures form and spread by a combination of processes including natural diffusion, forced convection due to air current draughts and by gravitationally affected upward displacement of molecules of one less dense gas or vapor by those of another more dense. Most common fuels stored in households are, as used, either gases with densities relatively close to that of air (eg. propane and butane) or liquids which form fumes having a density close to that of air, (eg. gasoline, which may contain butane and pentane among other components is very typical of such a liquid fuel).

In reconstructions of accidental ignition situations, and when gas water heaters are sometimes suspected and which involved spilt fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The present invention aims to substantially lower the probability of ignition in typical fuel spillage circumstances.

SUMMARY OF INVENTION

The invention provides a gas water heater including a water container adapted to be heated by a gas burner; an enclosure surrounding the burner and the water container, the water heater being characterized by having at least one opening adapted to allow air for combustion or extraneous fumes to enter the enclosure without igniting flammable extraneous fumes outside of the enclosure.

Preferably the at least one opening includes an aperture which is covered by a flame trap, which prevents the burner igniting extraneous fumes outside of the enclosure; and an air inlet through which air for combustion purposes is drawn.

Preferably the opening is remote from the gas burner and includes a duct for passage of air to the burner.

Preferably the opening and the aperture are collocated or are a single item.

Preferably the at least one opening is covered by a flame trap.

Preferably the aperture is in the enclosure.

Preferably the aperture is positioned close to a lower end of the enclosure.

Preferably the aperture is positioned in a lower end of the enclosure.

Preferably the aperture is positioned below the burner.

Preferably the aperture is positioned to allow air and fumes outside of the water heater to enter into an air passage leading to the burner.

Preferably the aperture allows air and fumes to enter the lowest point of the air passage.

Preferably one of or a combination of: a light detection or sensitive device; a flame detecting or sensitive device; a temperature sensitive or detecting device; a heat detecting or sensitive device; and an oxygen depletion sensitive or detection device, is located in the water heater to detect flame from the fumes if they have been ignited inside the enclosure.

Preferably the at least one opening includes an air inlet which is not covered by a flame trap, the air inlet having its lowest opening at a height of not less than about 500 millimeters or about 20 inches or more from the bottom of the enclosure.

Preferably the at least one opening is located at or adjacent to the highest point of the enclosure, if the enclosure has a height of about 500 millimeters or greater, from the bottom of the enclosure.

Preferably a snorkel device is provided to extend the at least one opening to a height above the highest point of the enclosure.

Preferably the flame trap includes a heat resistant permeable material having high thermal capacity.

Preferably the flame trap includes a screen selected from either woven or knitted mesh.

Preferably the flame trap is made of metal.

Preferably the flame trap is made of one of: steel, stainless steel, copper and aluminum.

Preferably a lint trap is included to wholly cover the aperture and the flame trap.

Preferably the lint trap is formed by mesh placed in the path of lint or dust travelling to the flame trap means.

Preferably the water heater includes a gas shut off means which shuts off the gas supply to the burner and or a pilot burner if the air and fumes are ignited after entering the enclosure.

Preferably the gas shut off means includes a heat sensitive means.

Preferably the gas shut off means includes a flame sensitive switch.

Preferably the gas shut off means includes an oxygen depletion sensitive means.

Preferably the enclosure comprises a separable jacket and base.

Preferably the flame trap is provided at or as part of the construction of joining areas of the base to the jacket, or the jacket to other component or the base to other component or at any location where the fumes could enter the enclosure.

Preferably the flame trap is inherent in or is formed by the joining areas including either only gaps or apertures of a size small enough to act as a flame trap.

Preferably the flame trap has been added to the joining area or is deliberately incorporated as part of the joining area.

Preferably the flame trap is a layer of metallic mesh cooperating with the joining area to achieve the flame quenching or arresting function.

Preferably the flame trap is inside of the water heater.

Preferably the gas shut off means includes a light detection means.

The invention further provides a water heater having a burner adapted to combust gas to heat a water container above the burner within an outer enclosure having an opening to admit air required to combust the gas; and including air and extraneous fume flow means co-operative with the opening to reduce or eliminate a possibility of extraneous fumes adjacent the enclosure being ignited outside the enclosure by a gas flame associated with the burner.

Preferably a fume detecting device is located in the water heater to detect fumes after they have entered the enclosure.

Preferably the at least one opening is positioned close to a lower end of the enclosure.

Preferably the at least one opening is positioned in a lower end of the enclosure.

Preferably the at least one opening is positioned below the burner.

Preferably the at least one opening is positioned so as to allow air and fumes outside of the water heater to enter into an air passage leading to the burner.

Preferably the at least one opening allows air and fumes to enter the lowest point of the air passage.

Preferably one of or a combination of: a light sensitive device; a flame detecting device; a temperature detecting device; a heat detecting device; and an oxygen depletion measurement device, is located in the water heater to detect flame from fumes after they have been ignited.

Preferably the flame trap is a flame quenching or arresting means.

Preferably the device or devices are included in a gas shut off device.

Preferably one of or a combination of: a light detection or sensitive device; a flame detecting or sensitive device; a temperature sensitive or detecting device; a heat detecting or sensitive device; and an oxygen depletion sensitive or detection device, is located in the water heater to detect flame from fumes if they have been ignited inside the enclosure.

Preferably device or devices are included in a gas shut off device.

The invention also provides a water heater having a burner adapted to combust gas to heat a water container above the burner within an outer enclosure having an opening to air required to combust the gas; and including air and extraneous fume flow means cooperative with the opening to reduce or eliminate a possibility of fumes adjacent the enclosure being ignited outside the enclosure by a gas flame associated with the burner; the water heater including gas shut off means which has a flame detecting or sensing device located in a path of flame external to a combustion chamber of the water heater and also located in any path of flame of fumes ignited in the enclosure.

Preferably the flame external to the combustion chamber is caused by flame spillage from the burner caused by a blockage of an exhaust flue.

Preferably the flame external to the combustion chamber is caused by air starvation in the combustion chamber.

One advantage of the invention is the provision of a barrier to the unprotected entry, at the lower end of the jacket or enclosure, of flammable extraneous fumes. In alternative embodiments it provides a protected entry means for such fumes near or at the base of the enclosure in which case these extraneous fumes are consumed in a controlled manner. The protected entry is, in the most preferred form, a flame trap preventing ignition of the remaining fumes in the surrounding atmosphere or of any liquid remaining nearby.

An advantage of locating the air intake for combustion purposes above the midpoint of the gas water system is that it reduces the chance of extraneous fumes entering the heater via the air intake because generally such flammables are heavier than air, which in the main do not attain dangerous levels at the air intake level.

The use of air close-off means and gas shut-off means activated by a trigger provides the advantage of suffocating any flame in the heater, or switching off the gas supply, or preventing uncontrolled or undirected ignition of gases or vapors from exiting the heater environment.

By providing an extended air intake, the risk of lint or dust affecting the efficiency of the water heater is reduced.

BRIEF DESCRIPTION OF THE DRAWINGS

An embodiment of the present invention will now be described, by way of example only, by reference to the accompanying drawings in which.

DETAILED DESCRIPTION OF THE DRAWINGS

Figure 1:
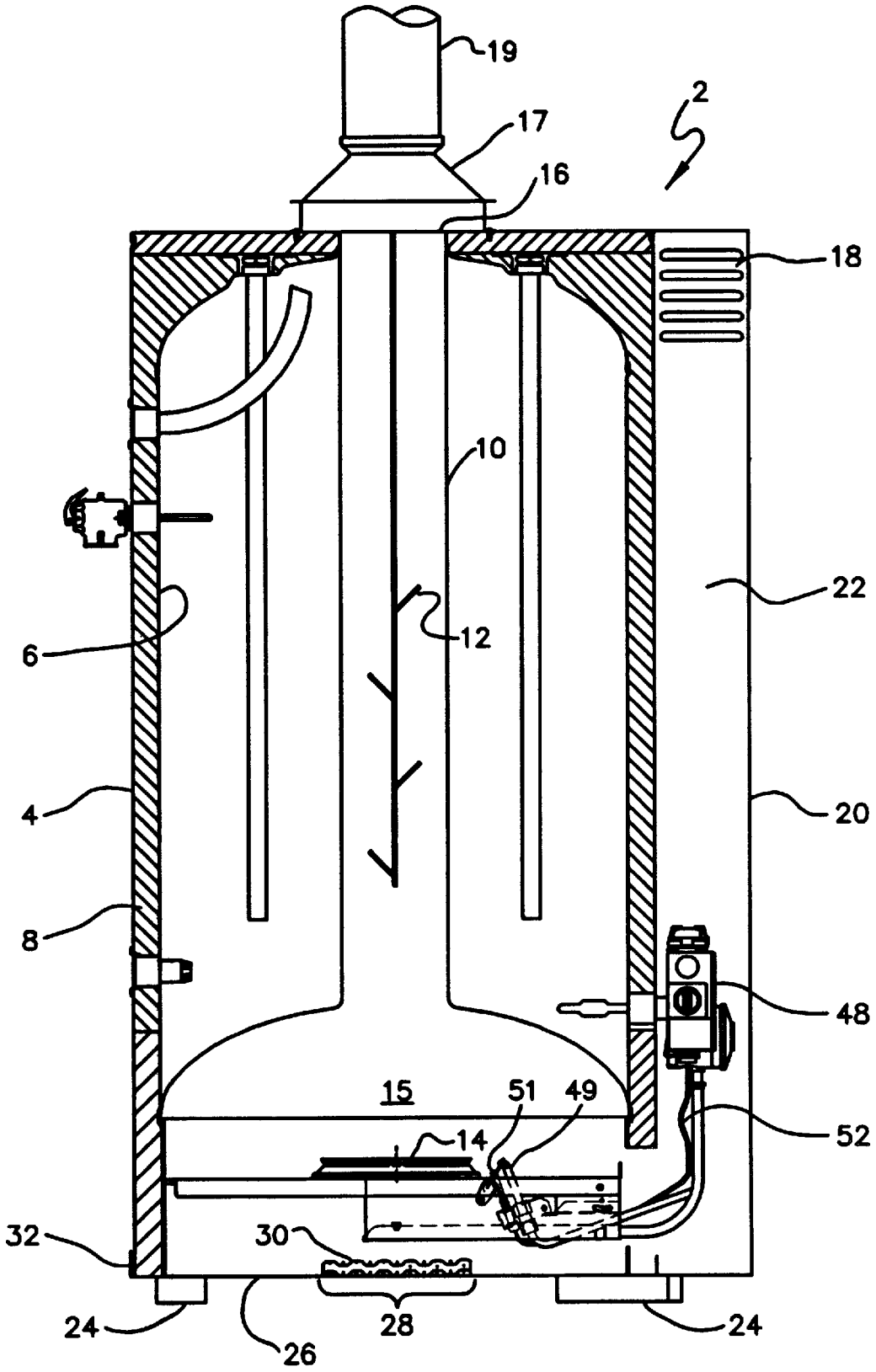
FIG. 1 is a cross section through a gas water heater embodying aspects of the present invention.

Illustrated in FIG. 1 is an assembly of a storage type gas water heater 2 including jacket 4 which surrounds a water tank 6, a main burner 14 in a combustion chamber 15. The water tank 6 is preferably of mains pressure capability and is capable of holding heated water. The water tank 6 is preferably insulated by foamed insulation 8. Alternative insulation may include fiberglass or other types of fibrous insulation and the like.

Located underneath the water tank 6 is the main burner 14 which uses natural gas or other gases such as LPG, for example. The main burner 14 combusts a gas and air mixture and the hot products of combustion resulting rise up through flue 10, possibly with heated air. Near the pilot burner 49, is a sheath 52, preferably made of copper, containing wires from a flame detecting thermocouple 51 which is a known safety measure to ensure that in the absence of a flame at the pilot burner 49 the gas control valve 48 shuts off the gas supply. Passing through the center of the tank 6 is a flue 10, in this instance incorporating a series of baffles 12 to better transfer heat generated by the main burner 14.

The products of combustion pass upwards and out the top of the jacket 4 via the flue outlet 16 after heat has been transferred from the products of combustion. The flue outlet 16 discharges conventionally into a draught diverter 17 which in turn connects to an exhaust duct 19 leading outdoors.

Close to the height of the top of the jacket 4 and the flue outlet 16 is an air inlet 18 through which air is drawn down the duct 22 to the main burner 14. The duct 22 is suitably constructed from sheet metal 20. In a non-illustrated alternative construction, a part or all of duct 22 may be inside the external cylindrical envelope of the jacket 4.

The heater 2 is preferably mounted on legs 24 to raise the base 26 off the floor. In the base 26 is an aperture 28 which is closed, but not gas tightly, by a flame trap device 30 (which operates on a flame quenching principle). The flame trap 30 is preferably made from two parallel sheets of mesh each about 0.010 inch diameter metal wire strands woven into mesh having about 30 to 40 strands per inch. Mild steel or stainless steel wire are suitable. Alternatively a ported ceramic tile of the SCHWANK type (registered trade mark) can be utilized although the recognized flame quenching ability of metallic woven or knitted mesh together with its robustness and ease of forming generally commends its use. The tile type functions as a flame quenching trap as long as the porosity is suitable.

A single layer of mesh or a porous ceramic tile may be susceptible to clogging by lint or other "blocking" materials such as dust or the like. Lint caught in the openings of a single mesh or a tile might act as a wick which may allow flame, which would not otherwise pass through the flame trap, to do so. In this situation the flame trap device would tend not to function as efficiently. To prevent this tendency, the flame trap is preferably constructed with either two layers of mesh or a layer of mesh and a tile. In this way the layer of mesh further from the source of fumes acts as a flame trap and the layer closer to the source of fumes acts as a lint trap.

Where the base 26 meets the jacket 4, the mating surfaces 32 (made up from surfaces of base 26 and jacket 4) can be sealed thoroughly to prevent ingress of air or any flammable gas or vapor. In FIG. 1, the mating surfaces 32 extend upwardly from the base 26 around the jacket 4. The cylindrical wall of jacket 4 (the majority of gas water heaters are cylindrical; however, a cubic shaped jacket 4 may be utilized) can be sealed gas tightly so no openings or breaks remain upon assembly and installation. In particular gas, water, electrical, control, or other connections, fittings or plumbing, wherever they pass through the jacket 4 or base 26, can be sealed airtight. The joining area (or mating surfaces 32) of base 26 to jacket 4 and all service entries or exits to the jacket 4 or duct 22 need not be sealed airtight providing they are designed and constructed being only minor surface to surface clearances or gaps, each of which is capable of acting as flame quenching traps. The structure of such service entries or exits are known in the art and not described herein. It is preferred, however, that the space around the burner be substantially air/gas tight except for means to supply combustion air.

Pilot flame establishment can be achieved by a Piezo-electric igniter. A pilot flame observation window can be provided which is sealed. Alternatively, if the pilot is to be lit by removing or opening an access, safety interlocks (not illustrated) are included to ensure complete closure against unprotected fume access during heater operation.

During normal operation, the heater 2 operates in the same fashion as conventional heaters except that most air for combustion enters at air inlet 18 and a small proportion through flame trap 30. However, if a spilt fuel is in the vicinity of the heater 2 then some gas or vapor from the spilt fuel is drawn in through the flame trap 30 before it builds up to a level to enter via air inlet 18. Flame trap 30 allows the combustible gas or vapor and air to enter but prevents flame escaping the jacket 4 or duct 22. The spilt fuel is burnt and exhausted either through the flue 10 via outlet 16 and duct 19 or through the duct 22 and inlet 18 (which in this case will act as an outlet). Because flame cannot pass outwardly through the flame trap 30, any spilt fuel external to the heater 2 will not be ignited.

Figure 2:
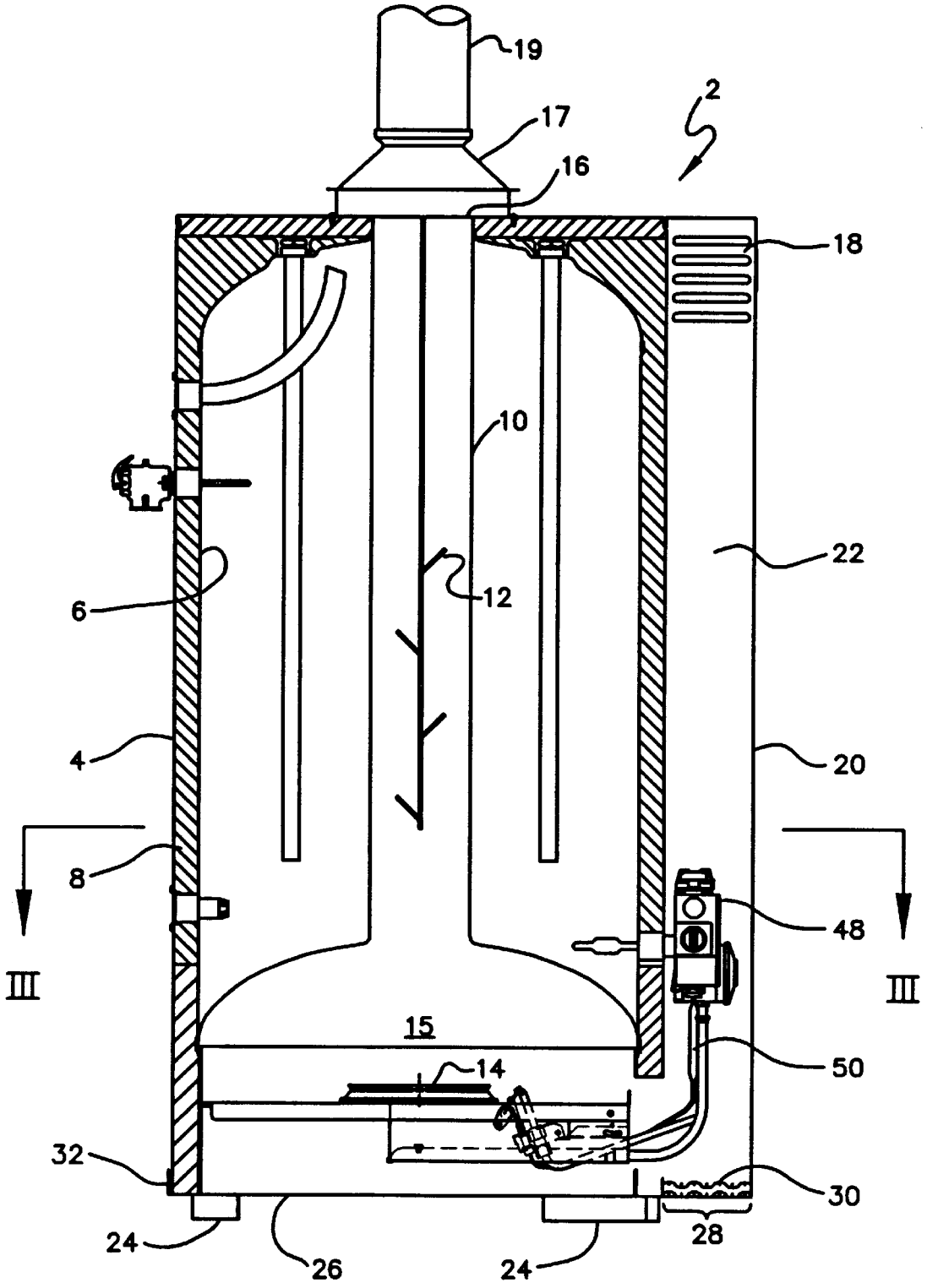
FIG. 2 is a cross section through a gas water heater similar to FIG. 1, with additional safety features (of flame trap and TSS)
Figure 3:
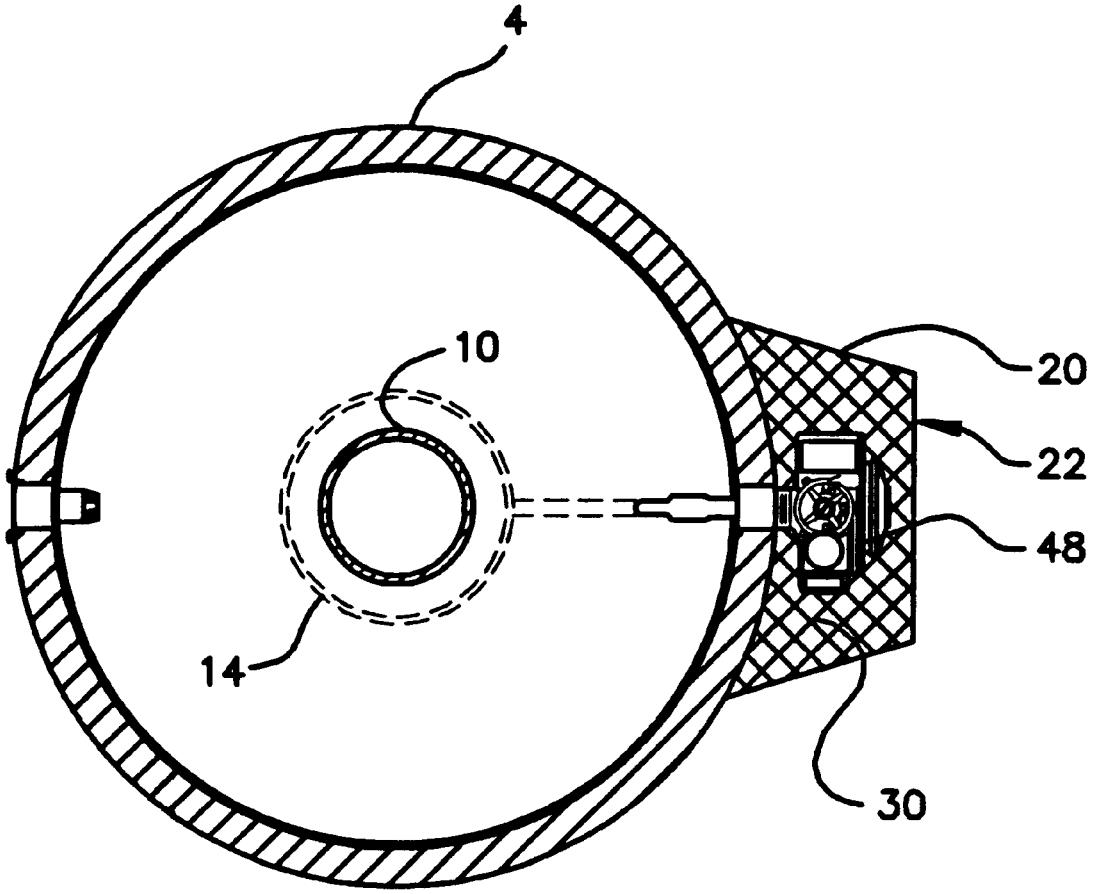
FIG. 3 is a cross section taken through the line 111—111 of FIG. 2.

FIGS. 2 and 3 show an embodiment similar to that of FIG. 1. Like parts use the same reference numbers as those of FIG. 1. In FIG. 2 there is, adjacent the gas control valve 48, a flame sensitive switch 50 which may be inserted in the same circuit as the pilot flame detecting thermocouple 51.

The flame sensitive switch may be substituted by a light detector or a heat detector. The flame sensitive switch can also be substituted by a gas, fume vapor detection switch which will close off gas control valve 48 if a flammable fume is detected.

With reference to the cross section depicted in FIG. 3, the duct 22 contains gas control valve 48 and the flame trap 30 is shown forming a bottom end of the duct. In fact, the flame trap 30 may be positioned spanning the bottom end of the duct 22 and an adjacent portion of the base 26. An advantage from such a positioning of the flame trap 30, including that shown in FIGS. 2 and 3, by comparison with the center position of base 26 shown in FIG. 1, is that it permits the positioning of a flame sensitive switch 50 (FIG. 2) directly below the gas control valve 48 which is also an ideal position to detect flame spillage from the combustion chamber 15 which can occur if, for example, the flue 16, or exhaust duct becomes blocked. Similarly it is ideally positioned to detect flame spillage such as would occur due to air starvation if inlet 18 were inadvertently blocked.

As shown in FIG. 3, opening 28 and flame trap 30 (including a lint trap device as mentioned above) are at the base of the duct 22 below the gas control valve 48 and flame detecting thermocouple 50 (see FIG. 2). In this way, should fumes which enter through flame trap 30 be ignited, a flame forms and burns on the inside surface of the flame trap and the flame detecting switch 50 actuates the gas control valve 48 to shut off the gas supply, thus removing it as a continuing source of ignition. After the pilot and main flames have been extinguished, any vapors of spilt fuel continuing to enter through the flame trap 30 may continue to burn because of the initial ignition and resulting suction of air and may continue to burn until there is insufficient flammable vapor remaining to be drawn in from the vicinity of the heater assembly 2.

By providing an air inlet 18 at a high position above the base 26, the more commonplace liquid fuels, the flammable gases and vapors are far less likely to be available to a gas water heater flame.

Figure 4:
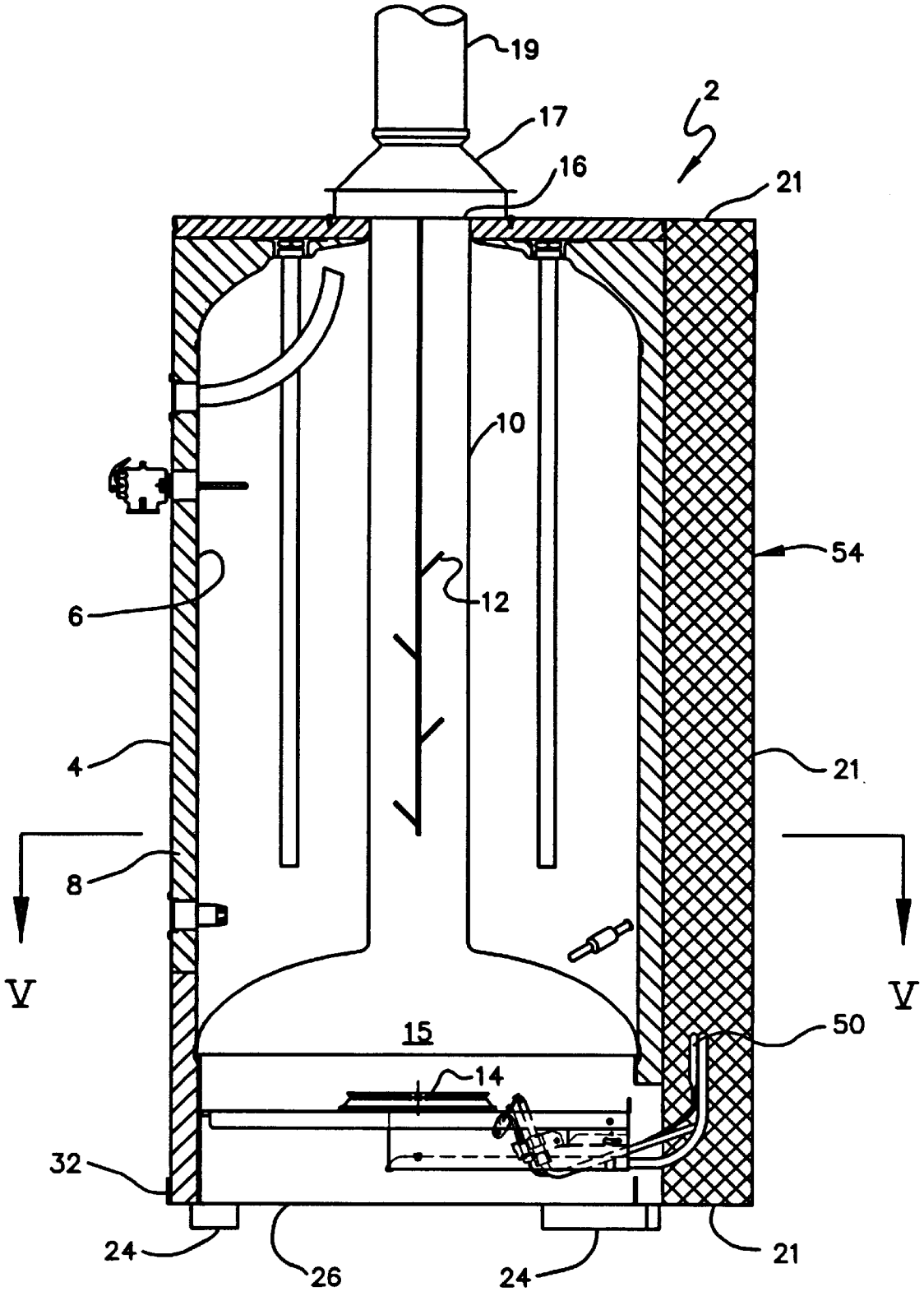
FIG. 4 is a cross section through a gas water heater similar to that of FIG. 2.
Figure 5:
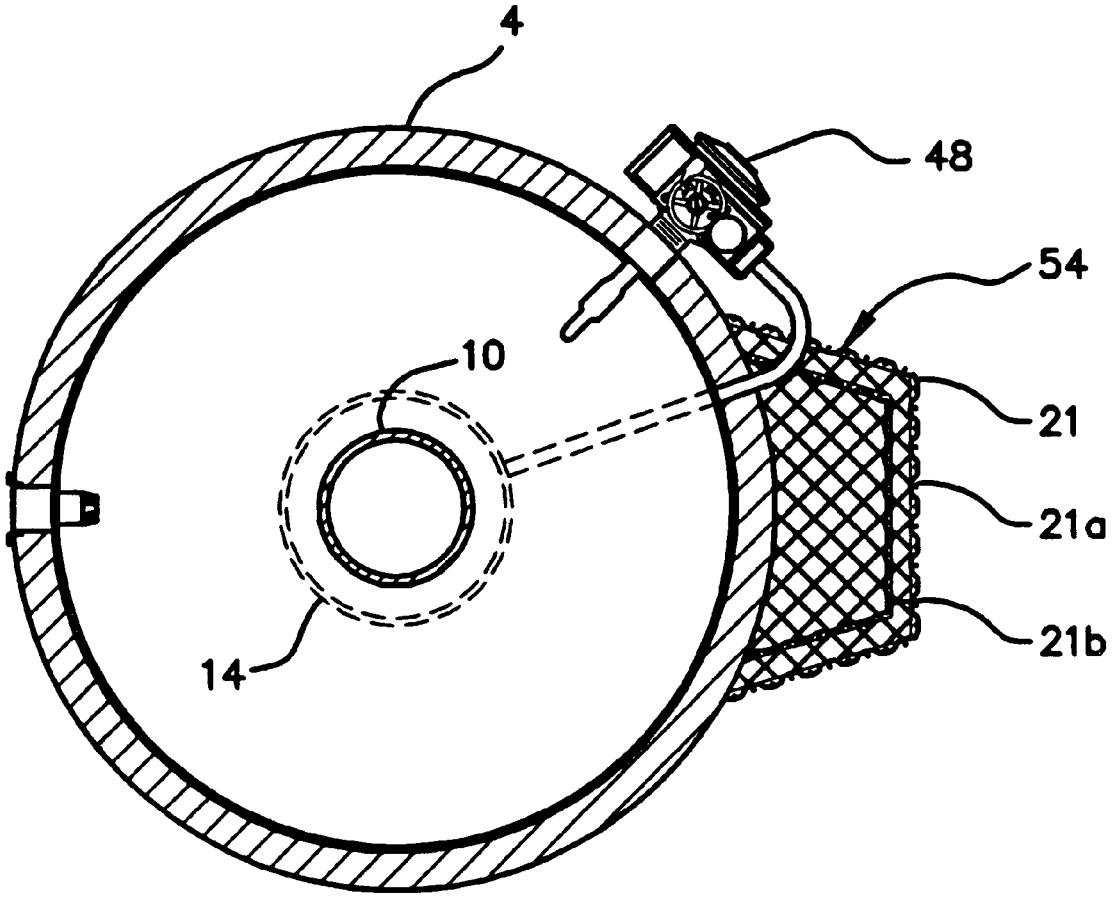
FIG. 5 is a cross section taken through line V—V of FIG. 4.

In the water heater 2 of FIGS. 4 and 5, the path for air entry to main burner 14 is provided by a combined flame trap and duct 54 fabricated of metallic mesh 21. This arrangement provides that all combustion air passes through a flame quenching surface 21 and the height of the duct 54 need not be as high as the jacket 4 nor need it necessarily extend upwardly. As evident in FIG. 5, it is preferably composed of the separated layers 21*a* and 21*b* of metallic mesh. This two layer construction avoids any layer of lint, deposited externally, providing a possible combustion path through the mesh, as previously explained.

Lint deposition in the openings of the mesh may be a cause of gradual blockage. In due course such linting may cause starvation of combustion air. Therefore an extended surface area (along the full height of water heater 2 as depicted for instance) of the combined flame trap and air duct 54 may be of advantage for prolonging the time taken for the duct 54 to become occluded with lint and for providing an adequate path for free induction of the air normally required for combustion.

The positioning of gas valve 48 in its preferred position is shown in FIG. 5 outside of the duct 54. The entry of the gas pipe and thermocouple sheath into the duct 54 is effected so that if a hole is left it is small enough either to be totally sealed or to act as a flame quenching trap.

The preference for the gas valve 48 outside the duct 54 is that it provides one way of providing user access to the control knob and any buttons on the gas control valve 48. It would be equally applicable in cases where the duct 22 is made of imperforate sheet metal 20 as shown in FIGS. 1 and 2.

For ease of construction one option is that the gas pipe and thermocouple sheath can enter the water heater 2 via an opening in the jacket 4, bypassing completely the duct 54. This opening can be then sealed or if a gap is left, the gap is sized to act as a flame trap. However, whichever way the thermocouple sheath passes to enter the combustion chamber, if it includes the flame sensitive switch 50 or other equivalent sensor, then it is greatly preferred that the flame sensitive switch 50 or other sensor is located in relation to the position of the flame trap 30 so that the relative positions co-operate in the event of a flame from spilt fuel forms on the flame trap.

Figure 6:
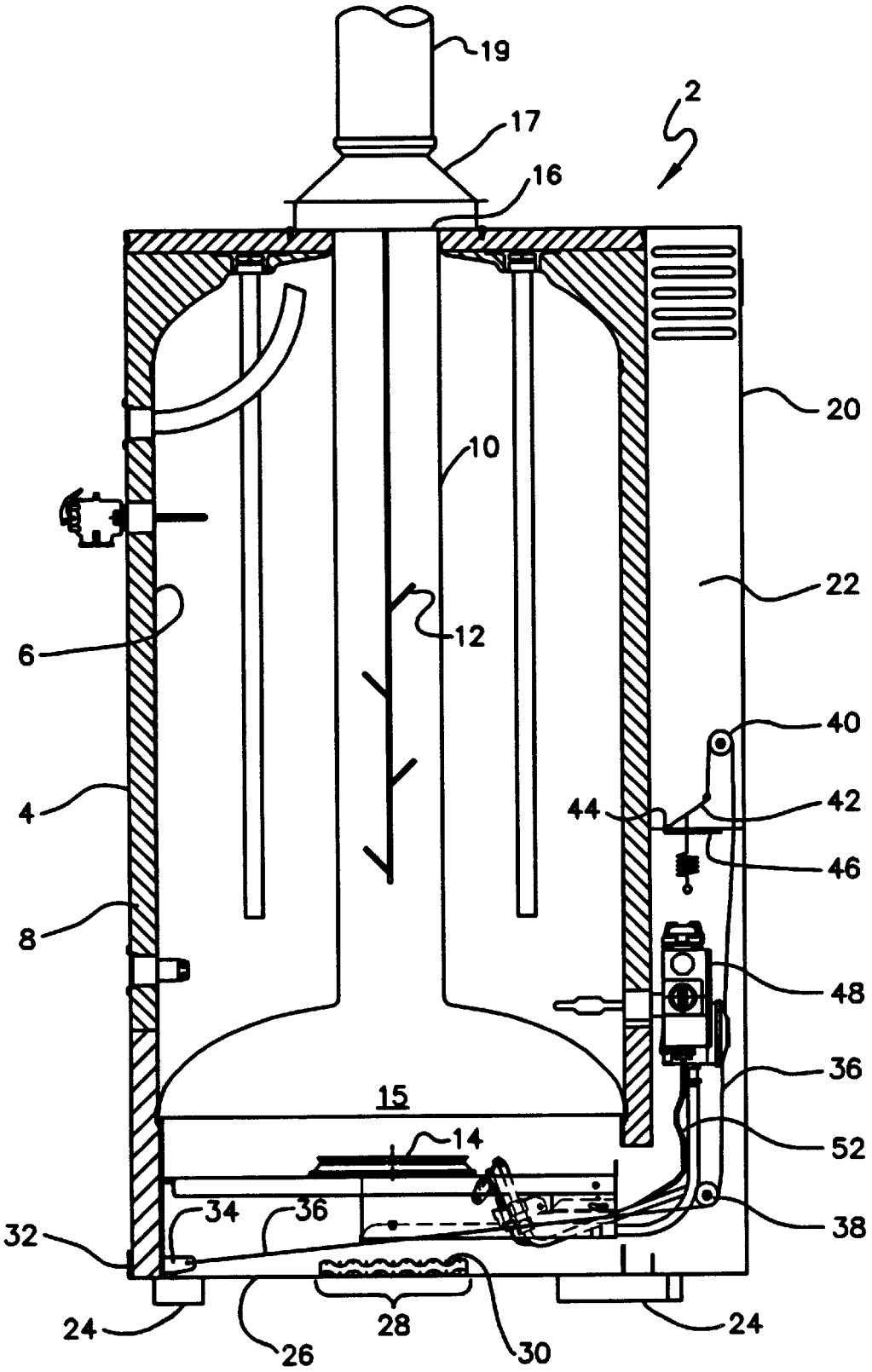
FIG. 6 is a cross section through a gas water heater with a safety feature (of air close-off means)

Illustrated in FIG. 6 is a another embodiment of the present invention, similar to that of FIG. 1, with like parts like numbered. This embodiment includes an anchor 34 which anchors a nylon line 36 which is a heat sensitive frangible member. The nylon line 36 passes close to the upper surface of the flame trap 30 and around a lower pulley 38 then continues on to an upper pulley 40 around which it passes through 180 degrees, to make connection with a flap 42. The flap 42 is connected by hinge 44 either to the inside of passage 22 or to a purpose built flange 46.

The flange 46, if it is utilized, can have a sealing medium (not illustrated) around it so that when the flap 42 makes contact with it, an air tight seal or a flame trap is formed. If the flange 46 is not utilized, the flap 42 can carry a seal so that, when released to move to a closed position, it will seal the inside of duct 22 to air tight quality or, in the alternative to form a flame trap. The flap 42 can be biased towards the closed position by a spring, which is a preferred method, or alternatively the biasing can be by means of gravity. If desired the flap 42 can be constructed from mesh, as described above to act as a flame trap.

In the embodiment of FIG. 6, when fumes from split fuel passing through the flame trap 30 are ignited, the heat of ignition breaking the nylon line 36, which is heat sensitive and frangible causing the flap 42 to move to a closed position, shutting off air supply to the main burner 14. This leaves no path down the duct 22 for air or combustible fumes which may have built up around the heater 2 to sufficiently gain access to the main burner 14 and so the pilot burner 49 and the main burner 14 may not have enough air available through the flame trap 30 to continue burning in which case the flame detection thermocouple 50 will cut off the gas supply until manual intervention can restore it when a safe atmosphere is restored.

In conjunction with any form of the invention as shown in FIGS. 1 to 6, a gas shut down facility similar to the above mentioned gas shut down ability can be provided. In another form, the gas shut down facility can be initiated by a flame sensitive switch (FSS) or a thermocouple. Such a thermocouple is preferably located just inside of the flame trap 30 where ever it appears. FSS's are also used in water heaters in circuit with the thermocouple (eg 50 of, FIG. 1) normally provided for confirming the establishment and retention of a pilot flame by raising an electric current flow to a level capable of keeping open a gas supply to the pilot burner.

FSS's are used to reduce fire hazards in circumstances where flame of the burner can "spill" through an air access opening adjacent the main and pilot burners. In known FSS'S, the heat sensor is externally positioned and in the present invention a FSS 50 is positioned above the flame trap 30 in order to sense flame heat input resulting from spilt flammable vapor burning on the inside of the flame trap 30 after having entered the combustion chamber through a possible entry path. In the embodiment of FIG. 1 the preferred position of the FSS (not illustrated) is immediately above the flame trap and it is preferred a small heat shield (not shown) be placed above the FSS to shield it from the normal radiant heat associated with the main burner 14. In FIG. 2, the FSS (50) is positioned a short way above the flame trap 30.

Figure 7:
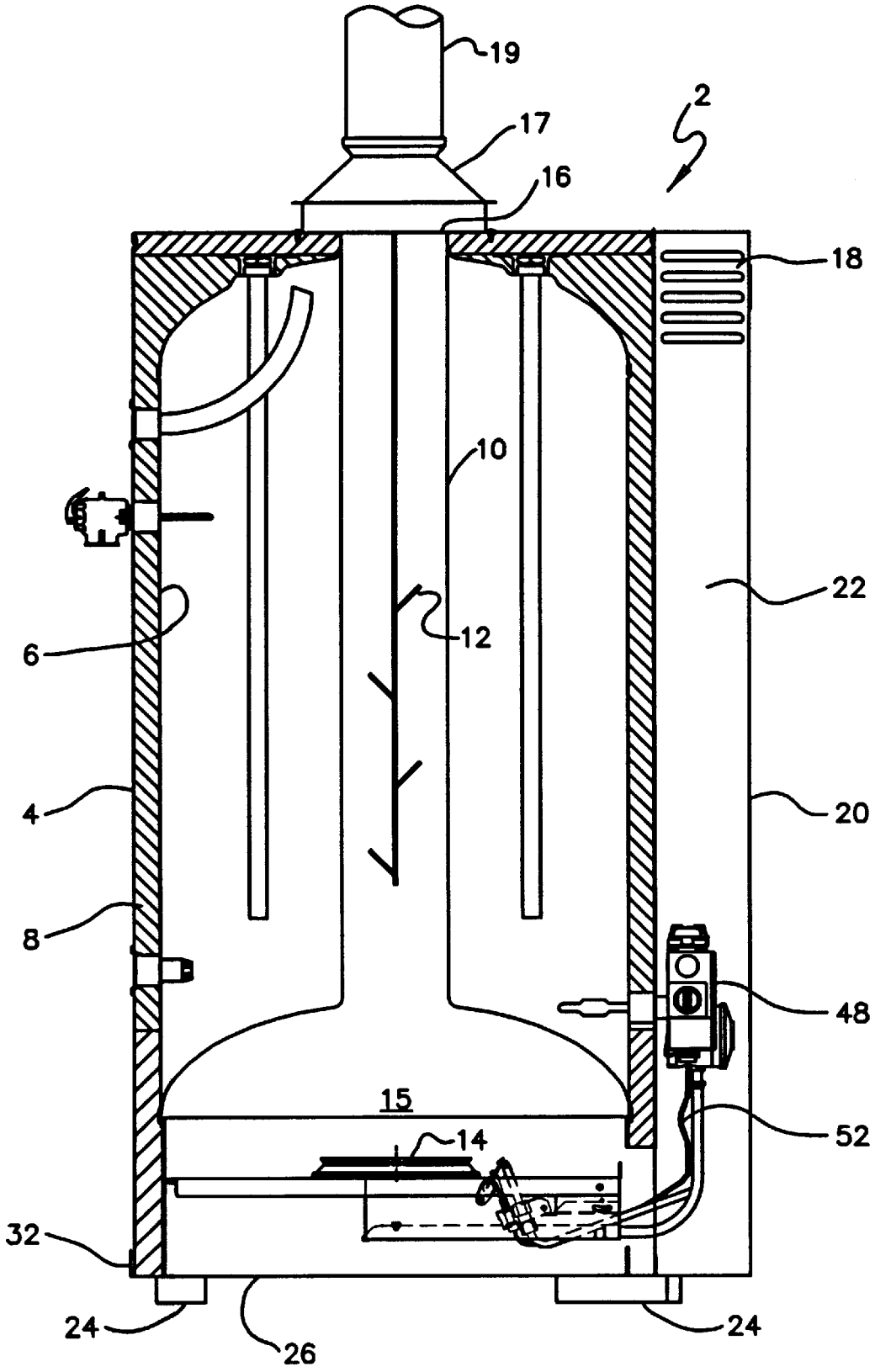
FIG. 7 is a cross section through a gas water heater of another embodiment of the present invention.
Figure 8:
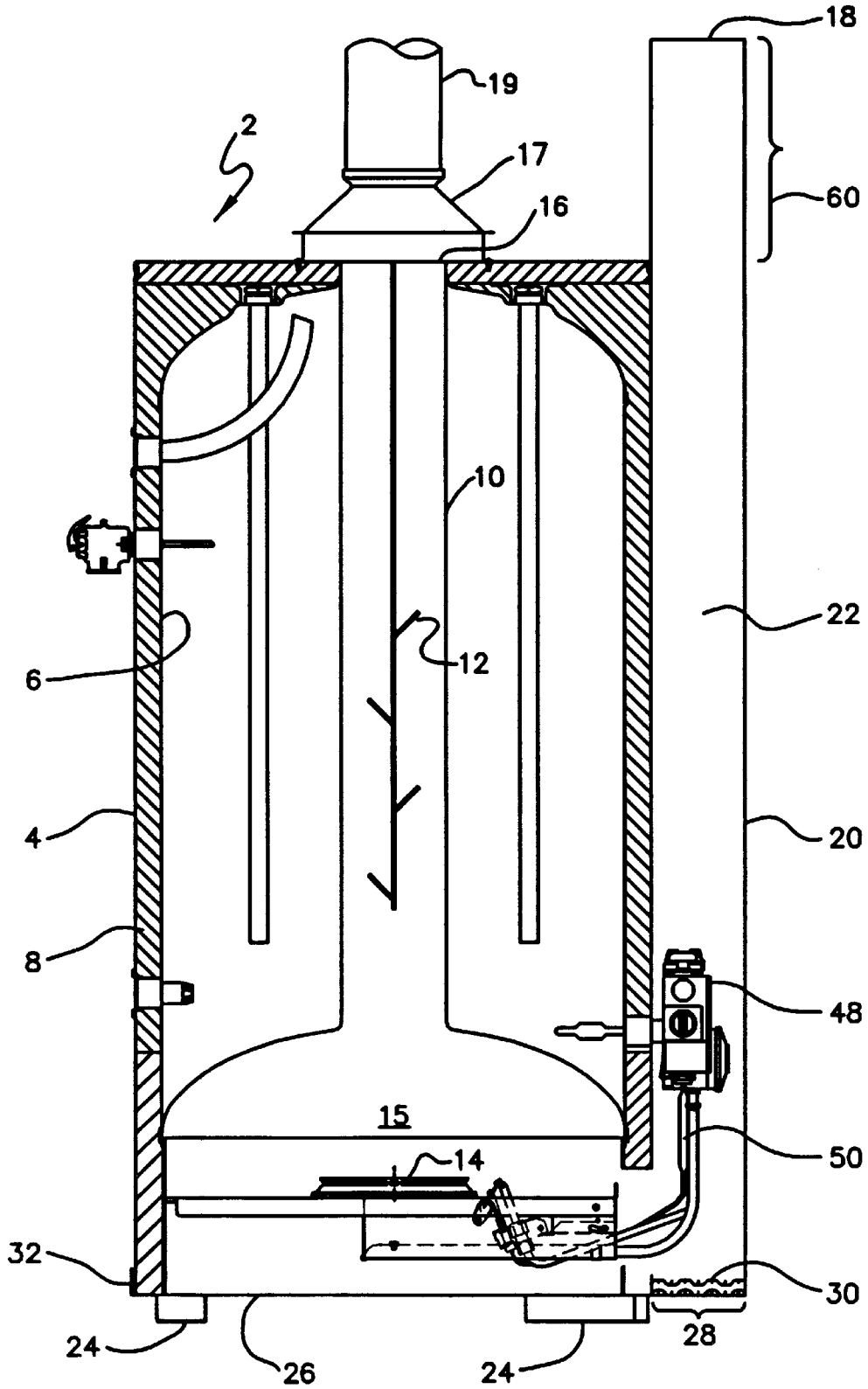
FIG. 8 is a cross section through a gas water heater of yet another embodiment of the present invention.

In FIGS. 7 and 8 are illustrated a gas water heater 2 constructed similarly to that illustrated in FIG. 1. The heater 2 includes a base 26 and jacket 4 which are either completely sealed (not illustrated) to air tight and flammable gas or vapor tight quality or alternatively, any gas paths unsealed are fine enough to act as flame traps. In this instance, when completely sealed, all air for combustion is drawn in from the air inlet 18, and there is no means present to ignite any spilt fuel at the lower portions of the heater 2.

The embodiments shown in FIGS. 7 and 8 have no flame trap 30 or opening 28. However, an appreciable time delay will occur before gases or vapors from spilt fuel rise to the elevated level of air inlet 18. Only then could the gases or vapors be drawn down passage 22 to the main burner 14. Many spillages, nevertheless are quite minor in terms of volume of liquid spilt and in such cases the embodiment of FIG. 7 would tend to provide an adequate level of protection and that of FIG. 8 even more so. The air inlet 18, if it does not include a flame trap 30, would need to be at least about 500 millimeters (20 inches) from the base 26 (if the base 26 is near to the ground), in the presence of gasoline fumes (a different height may be required for other fumes). However, for added protection a greater distance is preferred.

By providing an air inlet 18 at a high position above the base 26, the more frequently used typical flammable fumes of spilt liquid fuels, are far less likely to be available to a gas water heater flame.

If the base 26 and jacket 4 has small gaps or openings limited in their size in order to act as flame traps, then its operation will be similar to the embodiment of FIG. 1. The features of FIG. 6 can be incorporated also with the embodiments described in FIGS. 7 and 8 when the base 26 and jacket 4 are sealed. In this instance, because the water heater now includes a heat sensitive frangible member 36 located in an air passage in the vicinity of the main burner 14, if gases or vapors ignite having flowed down the passage 22 (which would indicate that the volume of gases or fumes had risen to the level of air entry of the air inlet 18), the resulting flame would melt a frangible member such as the nylon line 36 in the vicinity of main burner 14. The nylon line 36 can be connected in turn to a non-flammable and non-frangible section which in turn makes connection with a spring biased flap similar to flap 42 capable of sealing the passage 22. The distance between the nylon line 36 and the flap is sufficiently long to close the passage 22, before a flame travelling back up the passage 22 reaches the flap. If the flap is hinged so that its closing motion is in the direction that flame would have to travel to exit the passage 22, the hinging arrangement may be aided in closing by the movement of flame in a closing direction.

A further improvement to any of the above embodiments in the previous paragraph is to provide a snorkel 60 as shown in FIG. 8 extending the air inlet upwardly. The snorkel 60 allows air to be drawn to the main burner 14 but, by taking air from a height above the top of the jacket 4, will further reduce the risk of the heater 2 being an ignition source of flammable gases or vapors from spilt fuel. If the height of the jacket 4 is not greater than about 500 millimeters (20 inches) above the base 26, the snorkel 60 can be used to draw combustion air from a more appropriate height, depending upon the spillage which may occur.

Figure 9:
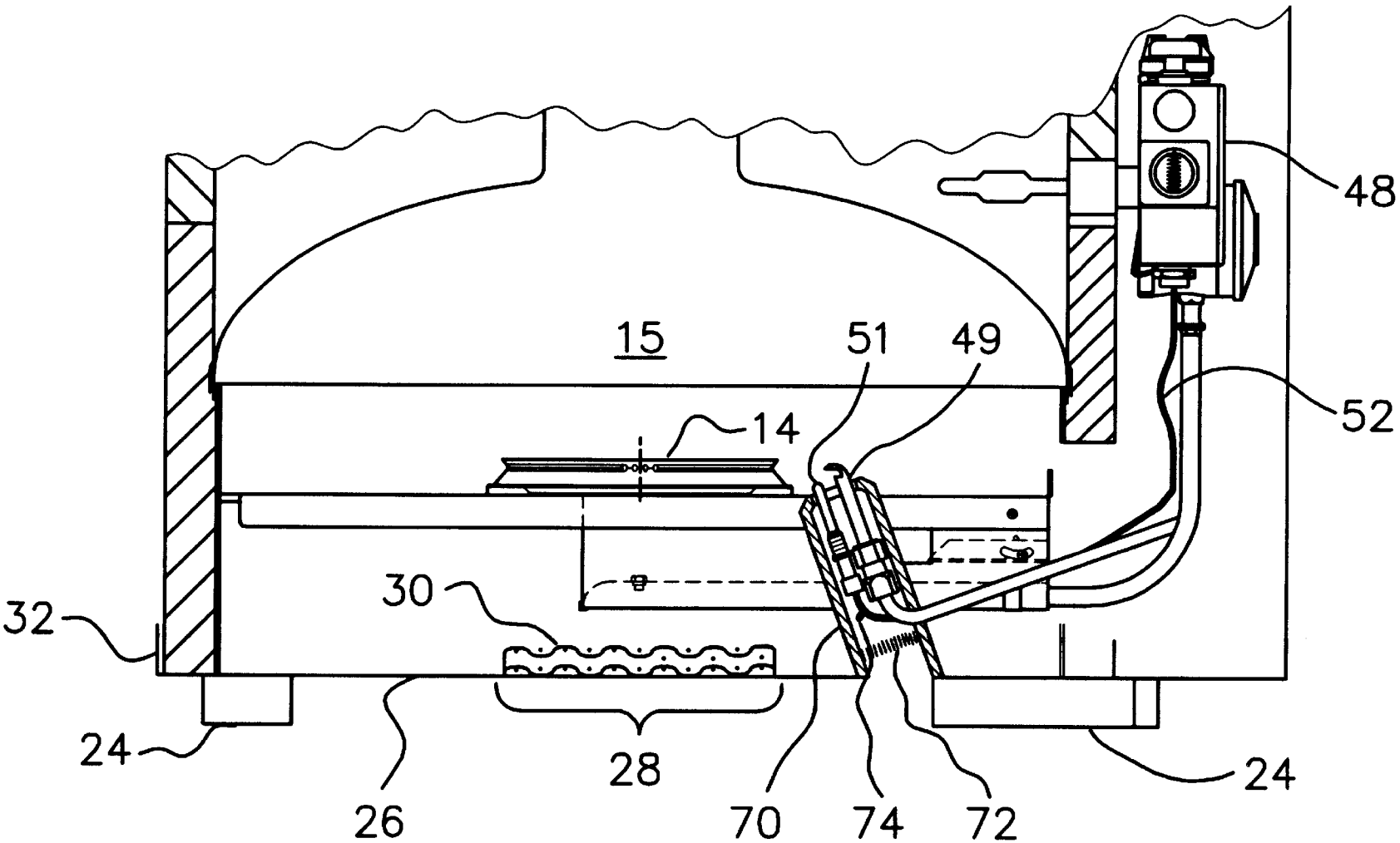
FIG. 9 is an exploded cross-section through the lower portion of another embodiment of the invention similar to that shown in FIG. 1.
Figure 10:
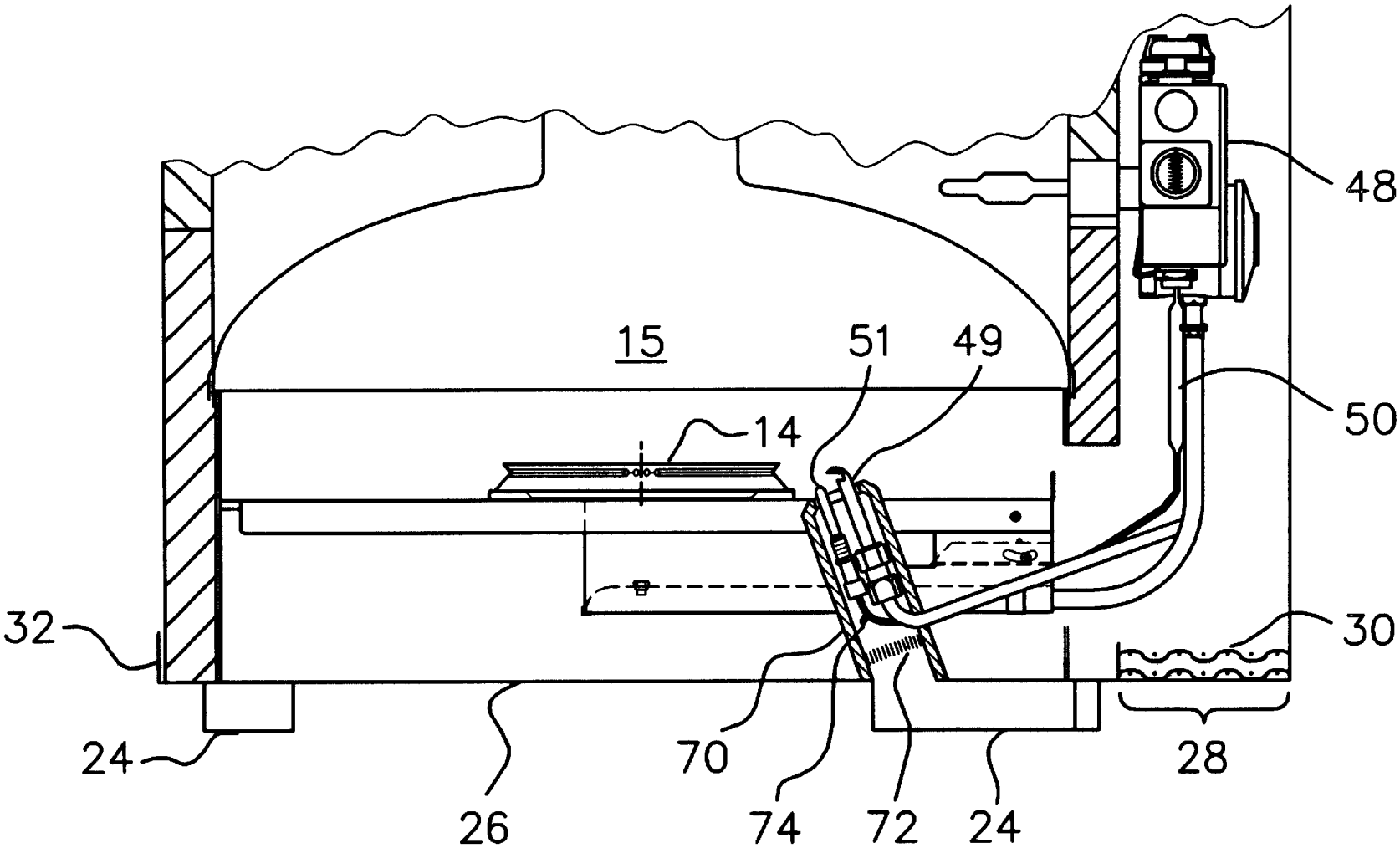
FIG. 10 is an exploded cross-section through the lower portion of another embodiment of the invention similar to that shown in FIG. 2.

FIGS. 9 and 10 show schematically an additional level of hazard reduction is provided by the addition of an oxygen depletion sensor 74 in conjunction with the pilot burner 49. This makes available the entire air requirement for the pilot flame to the pilot burner 49 only through a pilot air duct 70, gas tightly separate from the air supply duct 22 and the combustion chamber 15. The pilot air duct 70 has an air intake external to the remainder of the water heater assembly, preferably low to floor level where water heaters are generally installed, standing upright on a floor. At any convenient location in the pilot air duct 70 between the air intake end and the pilot burner 49 is a flame quenching insert 72, composed of one or more of a variety of high thermal capacity gas porous heat resistant materials such as described in relation to the flame trap 30. Locating the flame quenching insert 72 at or near the air intake end is advantageous to make it accessible for cleaning of lint or dust that may accumulate in it. In the pilot air duct 70 is also located an element 74 sensitive to oxygen depletion in the pilot air duct 70.

With these features added to any of the embodiments of FIGS. 1 to 7, the use of the oxygen depletion sensor 74 reduces the risk of ignition of escaping flammable vapor in particular when the pilot burner 49 is alight but the main burner 14 is not, by sensing oxygen depletion in the incoming pilot air supply if a flammable component in it ignites in which case it would cause the gas control valve 48 to shut down gas flow to the pilot burner 49. The shut down provides a time period for flammable vapor to safely ventilate. Resumption of normal operation of the water heater requires human intervention but, even if done ill-advisedly, in any event the oxygen depletion sensor 74 would continue to deny the pilot burner 49 of gas and the arrangement would behave safely even with extraneous flammable fumes remaining near the water heater. An oxygen depletion sensor 74 can be used alternatively in place of or in conjunction with the previously described flame sensing sensor 50 (FSS), and can be located similarly.

The invention thus far described can function at three levels of safety. The embodiment, as illustrated in relation to FIGS. 7 and 8, adds height and distance that fumes from spilt fuel must travel to reach the main burner 14 or pilot burner 49. The second embodiment, as illustrated in FIGS. 1, 2, 3 and 6, adds not only height and distance but also allows some and advantageously all the extraneous fumes to enter the base of the heater 2 and be consumed safely, conceivably until all residual risk of fire and explosion is avoided by dissipation of the spillage.

The third level, as illustrated in FIGS. 4 and 5, adds a further level of confidence by protecting all air entry with a flame arrestor, recognizing that high levels of airborne lint or other dust may tend to block the air intake and starve the burner of air for combustion if the air entry were not periodically cleared of that lint or other dust. The embodiment of FIGS. 4 and 5 can be constructed to protect against ignition of all flammable gases and vapors outside of the enclosure or jacket regardless of the density of those gases and vapors relative to air.

Whilst the above embodiments are directed to room or indoor installed gas water heaters, the improvements described will function in an outdoor environment, if spillages occur nearby and fumes enter the gas water heater.

The foregoing describes embodiments of the present invention and variations thereof and modification by those skilled in the art can be made thereto without departing from the scope of the invention. For example, the flame trap may be located at various positions other than those shown in the drawings and described above. One alternative position is in the side of the combustion chamber opposite the gas supply. In such a construction the flame trap would be located in an opening in the skirt below the water tank and extending through the corresponding portion of insulation.

In a further construction the flame trap is positioned above the height of entry to the combustion chamber and the FSS is positioned above that height of entry in the flow path of combustion air toward the burner. The aperture covered by the flame trap is in radiant heat communication with a FSS also positioned to be sensitive to flame roll out from flue blockage or combustion air starvation.

Further, the flame trap may be made from a variety of materials such as those described above, but can be fabricated from others not specifically identified so long as they permit passage of air and fumes in one direction but prevent flames from travelling in the opposite direction.

Suitable flame trap materials include those being porous, gas permeable and possessing sufficiently high thermal capacity to quench flame under typical conditions of use. Metallic structures having small holes, made from, for example, mild steel, stainless steel, copper or aluminum are suitable and porous ceramics including glass or mineral wool woven or non-woven constructions are also suitable. Fibre matrix ceramic is suitable as is flexible or rigid constructions.

Also, the air passage for combustion air, such as in the structure labelled 22 in FIG. 1, can be located between water tank 6 and jacket 4. The passageway can be of a variety of shapes and sizes and can be formed in and bounded by the insulation or can be formed by tubes, pipes conduits and the like.

Finally, main burner 14 and combustion chamber 15 can have different constructions such as those described in U.S. Pat. Nos. 4,924,816; 5,240,411; 5,355,841; and co-pending applications Ser. Nos. 08/333,871 and 08/113,618, for example, the subject matter of which is incorporated herein by reference.

What is claimed is:

1. A water heater comprising:

a water container;

a burner adapted to heat the water container;

an enclosure surrounding the burner, said enclosure defining an opening; and a flame trap positioned over said opening and adapted to allow air and extraneous fumes to enter the enclosure and prevent ignition of extraneous fumes outside of the enclosure.

2. The water heater of claim 1 wherein a lower portion of the water heater is a base and the opening is formed in the base.

3. The water heater of claim 1 wherein the enclosure is configured such that substantially all combustion air for the burner passes through the flame trap.

4. The water heater of claim 1 further comprising a pilot positioned adjacent said burner.

5. The water heater of claim 4 wherein said flame trap is positioned below said pilot.

6. The water heater of claim 1 wherein said flame trap is positioned below said burner.

7. The water heater of claim 1 further comprising an oxygen depletion sensor positioned in said enclosure.

8. The water heater of claim 7 wherein said oxygen depletion sensor is located adjacent a pilot burner positioned in said enclosure.

9. The water heater of claim 8 further comprising a pilot air duct extending from a lower portion of said water heater to said pilot burner to supply combustion air to said pilot burner, said pilot air duct containing a flame trap to allow air and extraneous fumes to enter said enclosure and prevent ignition of extraneous fumes outside said enclosure.

10. A water heater comprising:

a water tank;

a combustion chamber adjacent the tank;

a burner arranged to introduce hot products of combustion into the combustion chamber; and a flame trap positioned over an opening in a portion of structure associated with the combustion chamber, said flame trap permitting ingress of air and extraneous gases, if present, into the chamber and preventing egress of flames from said water heater.

11. The water heater of claim 10 wherein a lower portion of the water heater is a base and the flame trap is mounted in the base.

12. The water heater of claim 10 wherein the flame trap is configured such that substantially all combustion air for the burner passes through the flame trap.

13. The water heater of claim 10 further comprising a pilot positioned adjacent said burner.

14. The water heater of claim 13 wherein said flame trap is positioned below said pilot.

15. The water heater of claim 10 wherein said flame trap is positioned below said burner.

16. The water heater of claim 10 further comprising an oxygen depletion sensor positioned in said combustion chamber.

17. The water heater of claim 16 wherein said oxygen depletion sensor is located adjacent a pilot burner positioned in said combustion chamber.

18. The water heater of claim 17 further comprising a pilot air duct extending from a lower portion of said water heater to said pilot burner to supply combustion air to said pilot burner, said pilot air duct containing a flame trap to allow air and extraneous fumes to enter said combustion chamber and prevent ignition of extraneous fumes outside said combustion chamber.

* * * * *